US008602801B2

(12) United States Patent
Sylvester et al.

(10) Patent No.: US 8,602,801 B2
(45) Date of Patent: Dec. 10, 2013

(54) ELECTRICAL JACK

(75) Inventors: J. Scott Sylvester, Tomball, TX (US); William C Hallowell, Spring, TX (US); Ewoud Bonsen, Houston, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 8 days.

(21) Appl. No.: 13/403,305

(22) Filed: Feb. 23, 2012

(65) Prior Publication Data

US 2013/0225007 A1 Aug. 29, 2013

(51) Int. Cl.
*H01R 29/00* (2006.01)

(52) U.S. Cl.
USPC ..... 439/188

(58) Field of Classification Search
USPC ..... 439/188, 668, 669
See application file for complete search history.

(56) References Cited

U.S. PATENT DOCUMENTS 5,266,042 A * 11/1993 Hampel ..... 439/188
6,276,971 B1 * 8/2001 Belopolsky ..... 439/676
6,319,030 B1 * 11/2001 Wu ..... 439/188
6,676,423 B1 * 1/2004 Marowsky et al. ..... 439/181
6,780,035 B2 * 8/2004 Bohbot ..... 439/188
7,445,505 B1 * 11/2008 Yi ..... 439/607.01
7,597,572 B2 * 10/2009 Chapman et al. ..... 439/181
7,922,542 B1 * 4/2011 Shu et al. ..... 439/668
8,215,989 B2 * 7/2012 Tamm et al. ..... 439/607.01
8,216,000 B2 * 7/2012 Su et al. ..... 439/668
8,287,312 B2 * 10/2012 Riemeijer et al. ..... 439/620.21
8,362,654 B2 * 1/2013 Inha et al. ..... 307/112
2002/0151201 A1 * 10/2002 Bohbot ..... 439/188
2011/0081022 A1 * 4/2011 Tamm et al. ..... 381/1
2011/0165796 A1 * 7/2011 Riemeijer et al. ..... 439/620.21
2012/0015536 A1 * 1/2012 Huang et al. ..... 439/138
2012/0099742 A1 * 4/2012 Edeler ..... 381/120
2012/0250911 A1 * 10/2012 Tamm et al. ..... 381/300

* cited by examiner

*Primary Examiner* — Ross Gushi

(57) ABSTRACT

An electrical jack is disclosed herein. An example of such an electrical jack includes an enclosure configured to define a space in which the electrical plug is inserted. This example also includes an electrostatic discharge assembly positioned in the enclosure and configured to complete a closed circuit with each of the contacts of the electrical plug during insertion within the space, thereby discharging electrostatic energy present on the contacts of the electrical plug. The electrical plug is further configured to present an open circuit to each of the contacts of the electrical plug upon insertion of the electrical plug within the space to a predetermined point. Additional features of this electrical jack are disclosed herein, as are other examples of electrical jacks. An example of an electrical circuit is also disclosed herein.

21 Claims, 4 Drawing Sheets

ELECTRICAL JACK

BACKGROUND

Consumers appreciate quality and value in electrical devices. Reliability and safety are also desirable. Business may, therefore, want to create features and enhancements to their electrical devices directed towards one or more of these objectives.

BRIEF DESCRIPTION OF THE DRAWINGS

The following detailed description references the drawings, wherein.

DETAILED DESCRIPTION

Figure 1:
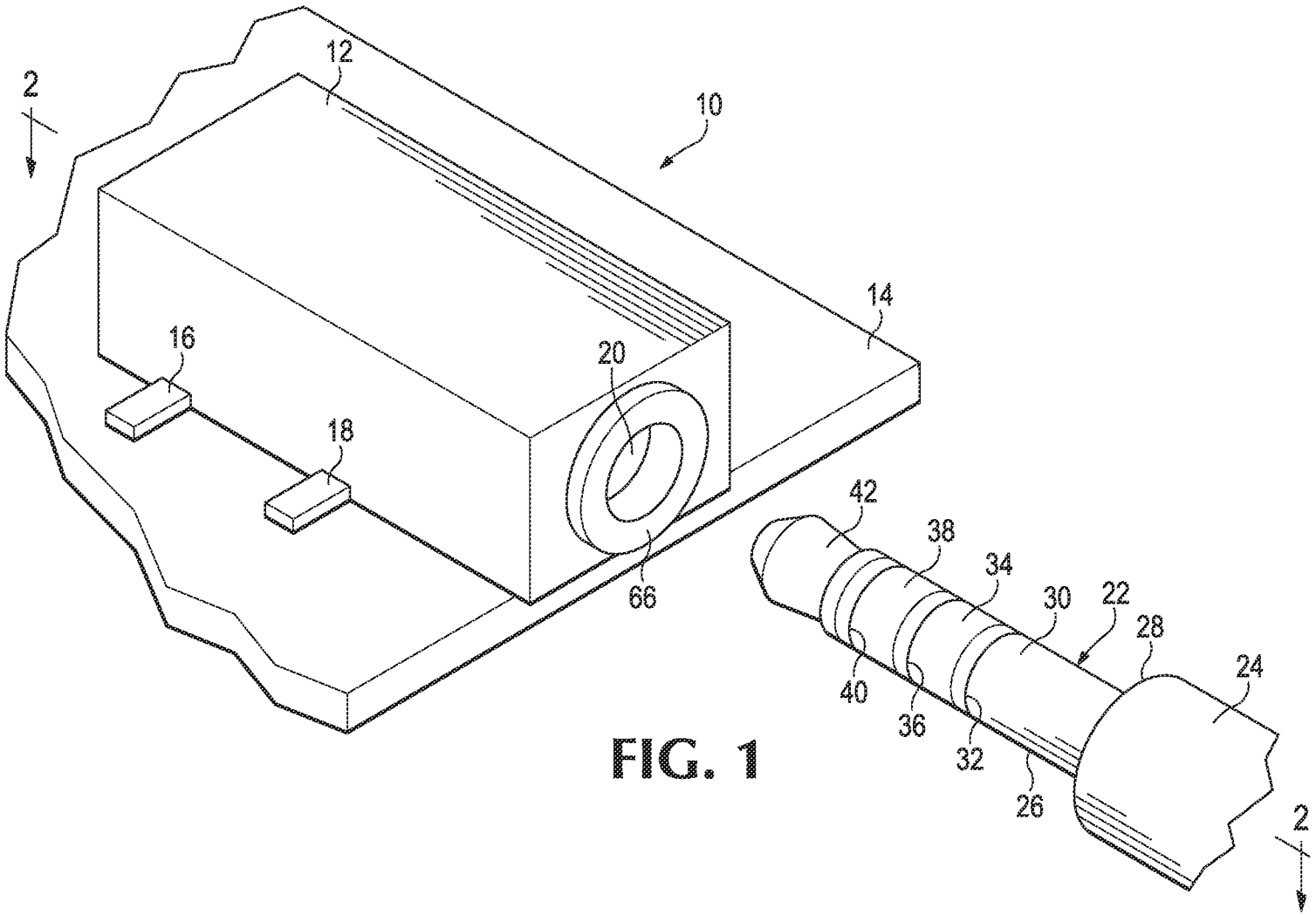
FIG. 1 shows a perspective view of an example of an electrical jack.

An electrostatic potential naturally occurs when two dissimilar materials touch. When this electrostatic potential is not grounded to Earth ground, electrostatic energy accumulates. A variety of commonly found things are known to carry electrostatic energy, including electrical plugs for peripheral devices such as headphones, earpieces, microphones, and electrical probes. Such electrostatic energy also builds up on people and sometimes manifests itself in the form of a visible electrostatic discharge or electrical shock when a person touches an object such as a door handle.

A similar electrostatic discharge occurs when an electrical plug having a build-up of electrostatic energy is inserted into an electrical jack that is connected to an electrical circuit of, for example, a computer, an audio component, a video component, a battery charger, or a piece of test and measurement equipment. Any time a device is plugged into another device with a differing electrical potential, electrostatic energy flows through the contact to bring both devices to the same potential energy. When the potential difference is high, the discharge will be sensed or even visible as a spark. When the potential difference is low, for example when the overall electrostatic energy build-up is small, there is no sensation or visible effect of the rebalancing of built-in charge. However, in both cases, energy flows through the circuitry of the devices being connected.

Electrostatic discharge can seriously damage such electrical circuits compromising their functioning and even ruining them, either in a single high-voltage discharge event or through accumulative damage done as a result of multiple smaller discharges. Traditional circuit protection devices are not designed to adequately protect against the many small discharges occurring with every single device insertion. In circuit protection devices, shunting to ground happens only after a certain overvoltage threshold is reached or exceeded and only after a delay, both of which allow amounts of electrostatic energy to flow into the unprotected circuitry. Over time, protection devices and device circuitry are weakened and may fail before the expected end-of-life of a product.

High-quality audio circuitry, or sensitive test and measurement circuits, require the use of an analog ground, which, for signal quality reasons, may not be connected to and thus separate from the usually electrically noisy digital ground. Digital ground is also typically referred to as chassis ground, and is often connected to the environmental Earth ground through the alternating current (AC) adapter or power supply of a device. As a result of the aforementioned separation between analog and digital ground, a plug-in device with a traditional electrical jack will not be connected to chassis ground upon insertion. This allows any built-up electrostatic charge to discharge through the analog circuitry or the analog ground rather than being cleanly routed or shunted to the digital ground directly or through traditional circuitry protection devices.

A perspective view of an example of an electrical jack 10 designed to address the issue of electrostatic discharge of shown in FIG. 1. can be seen in FIG. 1, electrical jack 10 includes a housing or enclosure 12 attached to a printed circuit board 14 via first contact 16 and second contact 18, by, for example, solder. Printed circuit board 14 may include one or more electrical circuits of, for example, a computer, audio component, video component, battery charger, or test and measurement equipment. Enclosure or housing 12 is configured to define a space or cavity 20 in which electrical plug 22 may be inserted or disposed. Electrical plug 22 may be connected to a variety of peripheral devices, such as headphones, earpieces, microphones, or electrical probes (not shown).

As can also be seen in FIG. 1, electrical plug 22 includes an electrically insulating base 24 that is connected on one end (not shown) to an above-described peripheral device via one or more wires or cables (also not shown). Electrical plug 22 additionally includes a longitudinally extended shaft 26 connected on other end 28 of base 24. Shaft 26 of electrical plug 22 includes a first contact 30 adjacent insulating base 24 and a first insulating ring 32. Shaft 26 also includes a second contact 34 located between first insulating ring 32 and second insulating ring 36. Shaft 26 additionally includes a third contact 38 positioned between second insulating ring 36 and third insulating ring 40. Shaft 26 further includes a plug tip contact 42 adjacent third insulating ring 40.

Figure 2:
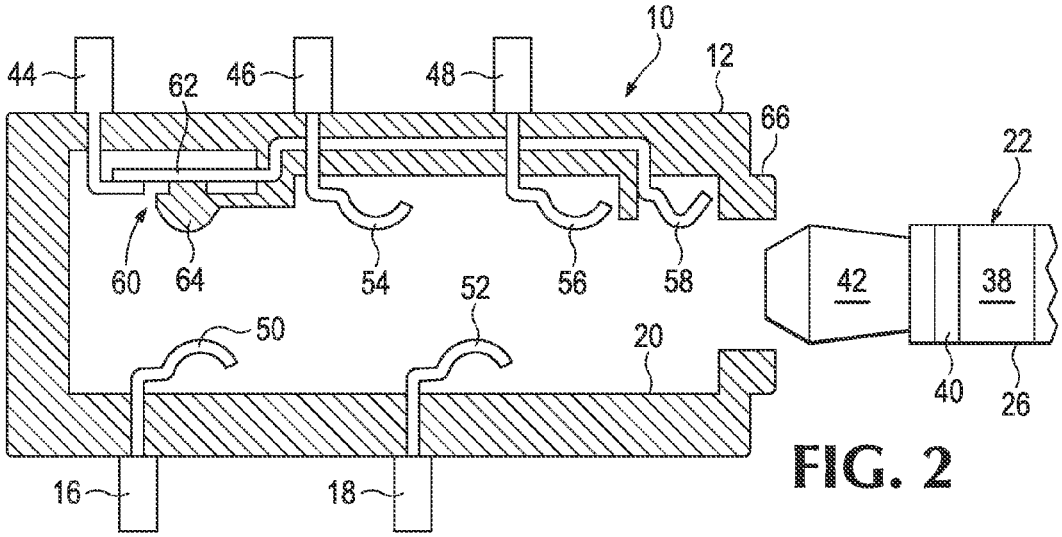
FIG. 2 is a cross-sectional view taken along line 2-2 of the example of the electrical jack of FIG. 1.

A cross-sectional view of electrical jack 10 taken along line 2-2 of FIG. 1 is shown in FIG. 2. A portion of electrical plug 22 is also shown. As can be seen in FIG, 2, housing or enclosure 12 of electrical jack 10 is additionally attached to a printed circuit board 14 via third contact 44, fourth contact 46, and fifth contact 48, by, for example, solder. In the example shown in FIG. 2 and subsequent FIGS. 3-7, first contact 16 of electrical jack 10 is electrically connected to a left audio signal of the electrical circuit on printed circuit board 14 and will be subsequently referred to as left audio signal contact 16. Second contact 18 is electrically connected to a common audio ground of the electrical circuit and will be subsequently referred to as common audio ground contact 18. Third contact 44 is electrically connected to an electrostatic discharge path and will be subsequently referred to as electrostatic discharge contact 44. Fourth contact 46 is electrically connected to a right audio signal of the electrical circuit on printed circuit board 14 and will be subsequently referred to as right audio signal contact 46. Fifth contact 48 is electrically connected to a microphone signal of the electrical circuit on printed circuit board 14 and will be subsequently referred to as microphone signal contact 48.

As can also be seen in FIG. 2, left audio signal contact 16 of electrical jack 10 includes a resilient member 50 positioned within cavity or space 20 defined by housing or enclosure 12, Common audio ground contact 18 of electrical jack 10 also includes a similar resilient member 52 positioned within cavity or space 20 defined by housing or enclosure 12. Right audio signal contact 46 includes a resilient member 54 positioned within cavity or space 20 defined by housing or enclosure 12. Microphone signal contact 48 includes a resilient member 56 positioned within cavity or space 20 defined by housing or enclosure 12. Each of resilient members 50, 52, 54, and 56 are configured to engage one of the contacts on electrical plug 22 when it is inserted within space or cavity 20 defined by housing or enclosure 12, as discussed more fully below. In the example illustrated FIGS. 2-8, each of resilient members 50, 52, 54, and 56 is additionally configured as a spring contact.

As can additionally be seen in FIG. 2, electrostatic discharge contact 44 includes a resilient member 58 positioned within cavity or space 20 defined by housing or enclosure 12. Resilient member 58 is configured to engage each of contacts 30, 34, 38, 42 of electrical plug 22 when it is inserted within space or cavity 20 defined by housing or enclosure 12, as discussed more fully below. In the example illustrated FIGS. 2-8, resilient member 58 is additionally configured as a spring contact.

As can further be seen in FIG. 2, electrical jack 10 includes an electrostatic discharge assembly 60 positioned in enclosure or housing 2. As discussed more fully below, electrostatic discharge assembly 60 is configured to complete a closed circuit with each of first contact 30, second contact 34, third contact 38, and plug tip contact 42 of electrical plug 22 during insertion within space or cavity 20, thereby discharging electrostatic energy present on first contact 30, second contact 34, third contact 38, and plug tip contact 42 of electrical plug 22 via the electrostatic discharge path. As also discussed more fully below, electrostatic discharge assembly 60 is further configured to present an open circuit to each of first contact 30, second contact 34, third contact 38, and plug tip contact 42 of electrical plug 22 upon insertion of electrical plug 22 within cavity or space 20 to a predetermined point.

Electrostatic discharge assembly 60 is additionally configured to include a switch 62 and the above-described electrostatic discharge contact 44. As can be seen in FIG. 2, switch 62 is electrically connected to above-described resilient member 58 positioned within cavity or space 20 defined by housing or enclosure 12. In the example shown, switch 62 is configured to assume a normally closed position connected to electrostatic discharge contact 44. Electrostatic discharge assembly 60 is additionally configured to include an actuator 64 positioned within space or cavity 20 adjacent switch 62 and designed to electrically insulate switch 62 from first contact 30, second contact 34, third contact 38, and plug tip contact 42 of electrical plug 22. As discussed more fully below, actuator 64 is additionally configured to deflect toward switch 62 upon engagement with electrical plug 22 inserted within cavity or space 20. This deflection of actuator 64 moves switch 62 from its normally closed position to an open position disconnected from electrostatic discharge contact 44 and the electrostatic discharge path.

Figure 3:
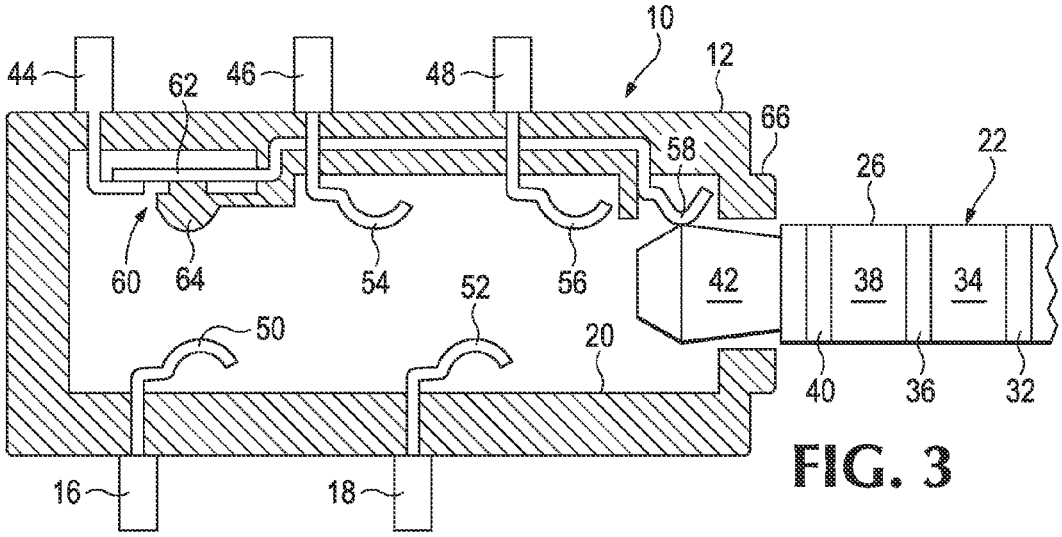
FIG. 3 is the cross-sectional view of the electrical jack of FIG. 2 showing a portion of an inserted electrical plug.

A cross-sectional view of electrical jack 10 showing a portion of electrical plug 22 inserted within space or cavity 20 defined by housing or enclosure 12 is shown in FIG. 3. As can be seen in FIG. 3, resilient member 58 is engaging plug tip contact 42 of electrical plug 22. This engagement electrically connects plug tip contact 42 with switch 62 of electrostatic discharge assembly 60. This connection in turn creates or establishes a closed circuit between plug tip contact 42 and electrostatic discharge contact 44, thereby discharging electrostatic energy that may be present on plug tip contact 42 via the electrostatic discharge path.

Figure 4:
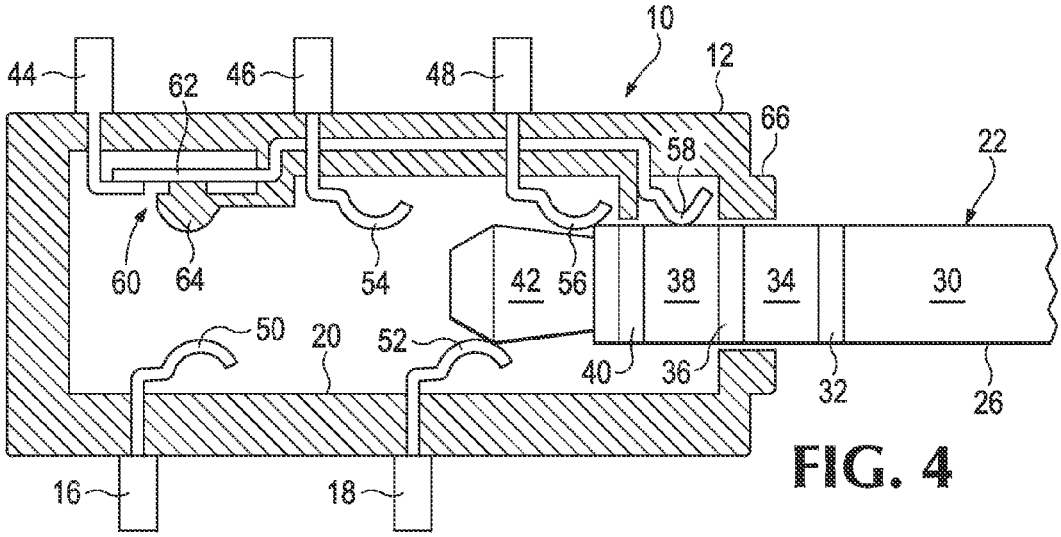
FIG. 4 is the cross-sectional view of the electrical jack of FIG. 3 showing an additional portion of the inserted electrical plug.

A cross-sectional view of electrical jack 10 showing an additional portion of electrical plug 22 inserted within space or cavity 20 defined by housing or enclosure 12 is shown in FIG. 4. As can be seen in FIG. 4, resilient member 58 is now engaging third contact 38 of electrical plug 22. This engagement electrically connects third contact 38 with switch 62 of electrostatic discharge assembly 60. This connection in turn creates or establishes a closed circuit between third contact 38 and electrostatic discharge contact 44, thereby discharging electrostatic energy that may be present on third contact 38 via the electrostatic discharge path. As can also be seen in FIG. 4, resilient members 52 and 56 are both now engaging plug tip contact 42 of electrical plug 22. This engagement electrically connects plug tip contact 42 with both common audio ground contact 18 and thus the common audio ground of the circuit on printed circuit board 14, as well as microphone signal contact 48 and thus the microphone circuitry on printed circuit board 14. However, there is no risk of damage to either the common audio ground of this circuit or the microphone circuitry due to electrostatic energy on plug tip contact 42 because any such electrostatic energy was previous removed via prior contact with resilient member 58 and electrostatic discharge assembly 60, as discussed above.

Figure 5:
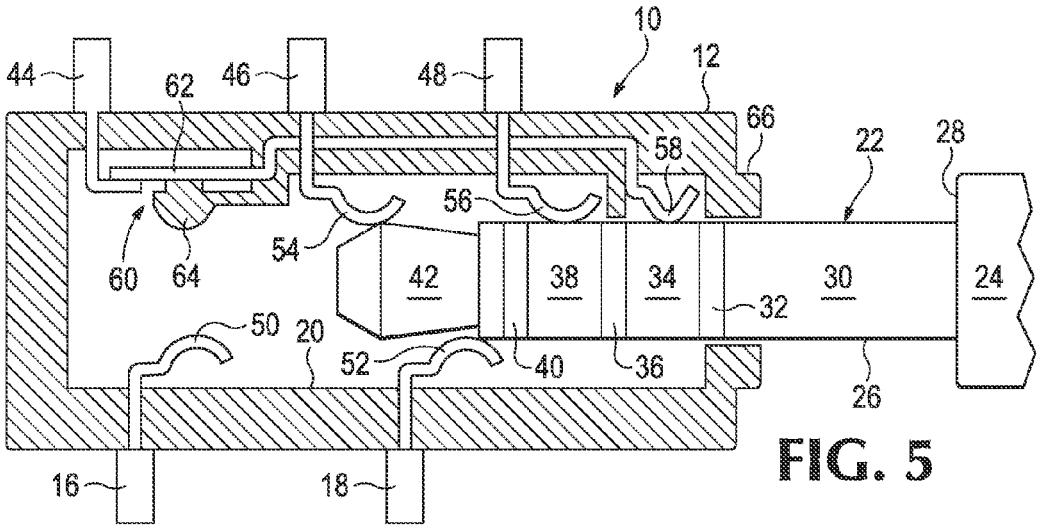
FIG. 5 is the cross-sectional view of the electrical jack of FIG. 4 showing a further portion of the inserted electrical plug.

A cross-sectional view of electrical jack 10 showing a further portion of electrical plug 22 inserted within space or cavity 20 defined by housing or enclosure 12 is shown in FIG. 5. As can be seen in FIG. 5, resilient member 58 is now engaging second contact 34 of electrical plug 22. This engagement electrically connects second contact 34 with switch 62 of electrostatic discharge assembly 60. This connection in turn creates or establishes a closed circuit between second contact 34 and electrostatic discharge contact 44, thereby discharging electrostatic energy that may be present on second contact 34 via the electrostatic discharge path. As can also be seen in FIG. 5, resilient members 52 and 54 are now both engaging plug tip contact 42 of electrical plug 22. This engagement electrically connects plug tip contact 42 with both common audio ground contact 18 and thus the common audio ground of the circuit on printed circuit board 14, as well as the right audio signal contact 46 and thus the right audio circuitry on printed circuit board 14. However, there is no risk of damage to either the common audio ground of this circuit or the right audio circuitry due to electrostatic energy on plug tip contact 42 because any such electrostatic energy was previous removed via prior contact with resilient member 58 and electrostatic discharge assembly 60, as also discussed above.

As can further be seen in FIG. 5, resilient member 56 is now engaging third contact 38 of electrical plug 22. This engagement electrically connects third contact 38 with microphone signal contact 48 and thus the microphone circuitry on printed circuit board 14. However, there is no risk of damage to the microphone circuitry due to electrostatic energy on third contact 38 because any such electrostatic energy was previous removed via prior contact with resilient member 58 and electrostatic discharge assembly 60, as discussed above.

Figure 6:
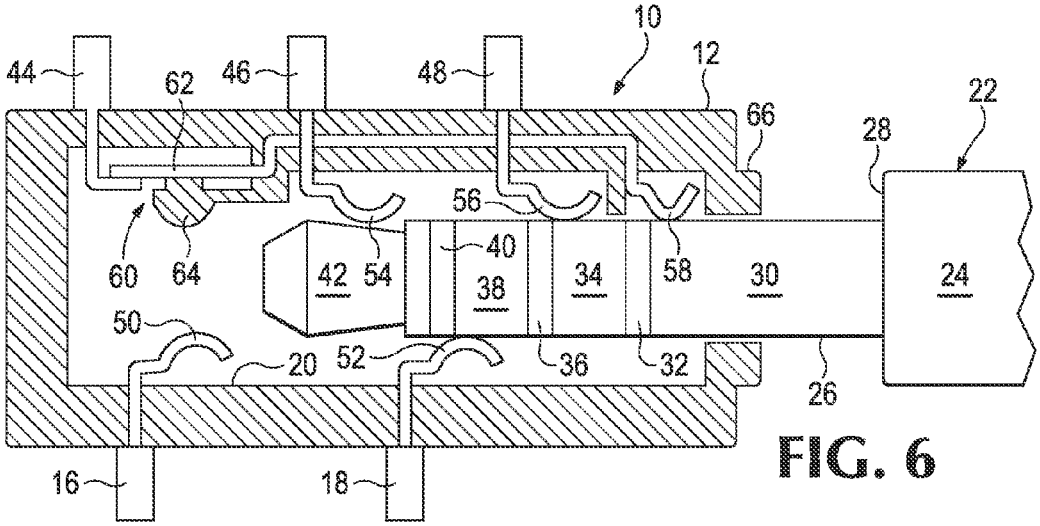
FIG. 6 is the cross-sectional view of the electrical jack of FIG. 5 showing yet a still further portion of the inserted electrical plug.

A cross-sectional view of electrical jack 10 showing yet a still further portion of electrical plug 22 inserted within space or cavity 20 defined by housing or enclosure 12 is shown in FIG. 6. As can be seen in FIG. 6, resilient member 58 is now engaging first contact 30 of electrical plug 22. This engagement electrically connects first contact 30 with switch 62 of electrostatic discharge assembly 60. This connection in turn creates or establishes a closed circuit between first contact 30 and electrostatic discharge contact 44, thereby discharging electrostatic energy that may be present on first contact 30 via the electrostatic discharge path. As can also be seen in FIG. 6, resilient member 54 is now engaging plug tip contact 42 of electrical plug 22. This engagement electrically connects plug tip contact 42 with right audio signal contact 46 and thus the right audio circuitry on printed circuit board 14. However, there is no risk of damage to the right audio circuitry due to electrostatic energy on plug tip contact 42 because any such electrostatic energy was previous removed via prior contact with resilient member 58 and electrostatic discharge assembly 60, as also discussed above.

As can further be seen in FIG. 6, resilient member 52 is now engaging third contact 38 of electrical plug 22. This engagement electrically connects third contact 38 with common audio ground contact 18 and thus the common audio ground of the circuit on printed circuit board 14. However, there is no risk of damage to the common audio ground of this circuit due to electrostatic energy on third contact 38 because any such electrostatic energy was previous removed via prior contact with resilient member 58 and electrostatic discharge assembly 60, as discussed above. As can additionally be seen in FIG. 6, resilient member 56 is now engaging second contact 34 of electrical plug 22. This engagement electrically connects second contact 34 with microphone signal contact 48 and thus the microphone circuitry on printed circuit board 14. However, there is no risk of damage to the microphone circuitry due to electrostatic energy on second contact 34 because any such electrostatic energy was previous removed via prior contact with resilient member 58 and electrostatic discharge assembly 60, as also discussed above.

Figure 7:
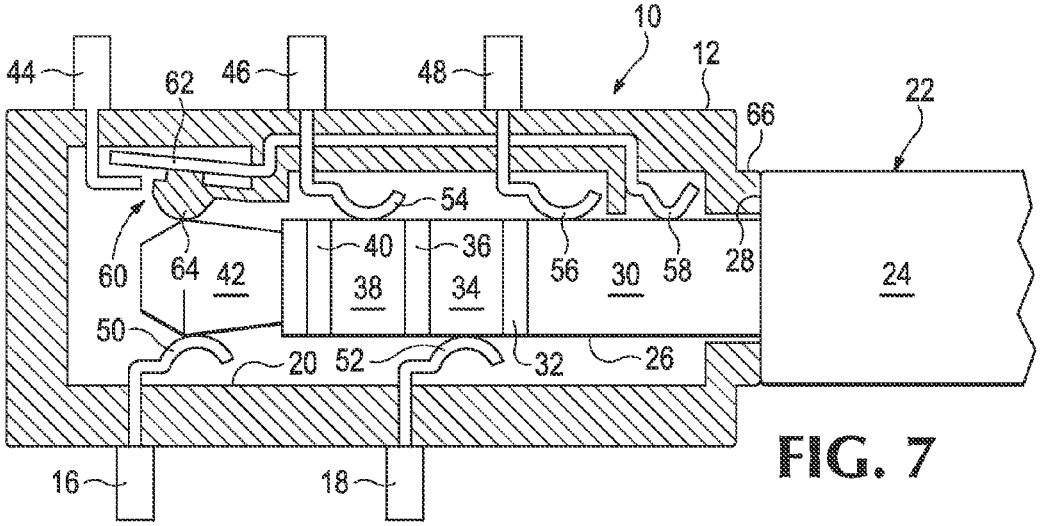
FIG. 7 is the cross-sectional view of the electrical jack of FIG. 6 showing full insertion of the electrical plug.

A cross-sectional view of electrical jack 10 showing full insertion of electrical plug 22 to a predetermined point within space or cavity 20 defined by housing or enclosure 12 is shown in FIG. 7. In this example, this predetermined point of insertion of electrical plug 22 within cavity or space 20 is selected to be a point within space or cavity 20 corresponding to an inserted length of electrical plug 22. In this case, the inserted length of electrical plug 22 is substantially equal to the extent of longitudinally extending shaft 26. Ring or stop 66 on housing or enclosure 12 is utilized to control the extent of insertion of electrical plug 22 within cavity or space 20 to the predetermined point. This is accomplished by abutment between stop or ring 66 and end 28 of insulating base 24 of electrical plug 22, as shown.

As can be seen in FIG. 7, resilient member 50 is now engaging plug tip contact 42 of electrical plug 22. This engagement electrically connects plug tip contact 42 with left audio signal contact 16 and thus the left audio circuitry on printed circuit board 14. However, there is no risk of damage to the left audio circuitry due to electrostatic energy on plug tip contact 42 because any such electrostatic energy was previous removed via prior contact with resilient member 58 and electrostatic discharge assembly 60, as also discussed above. As can also be seen in FIG. 7, plug tip contact 42 of electrical plug 22 is engaged with electrically insulated actuator 64 and, as a result of this engagement, has deflected actuator 64 toward switch 62. This deflection of actuator 64 moves switch 62 from its normally closed position to an open position, as shown. This in turn causes electrostatic discharge assembly 60 to present an open circuit to each of first contact 30, second contact 34, third contact 38 and plug tip contact 42 of electrical plug 22, thereby electrically isolating electrostatic discharge contact 44 and the electrostatic discharge path from first contact 30, second contact 34, third contact 38 and plug tip contact 42 of electrical plug 72.

As can additionally be seen in FIG. 7, resilient member 58 is still engaging first contact 30 of electrical plug 22. However, this engagement now does not result in electrical connection between first contact 30 and electrostatic discharge assembly 60 because of the open position of switch 62 which creates or establishes an open circuit between first contact 30 and electrostatic discharge contact 44. Rather, first contact 30 of electrical plug 22 is engaged by resilient member 56. This engagement electrically connects first contact 30 with microphone signal contact 48 and thus the microphone circuitry on printed circuit board 14. However, there is no risk of damage to the microphone circuitry due to electrostatic energy on first contact 30 because any such electrostatic energy was previous removed via prior contact with resilient member 58 and electrostatic discharge assembly 60 when switch 62 was closed, as also discussed above.

As can further be seen in FIG. 7, resilient member 54 is now engaging third contact 38 of electrical plug 22. This engagement electrically connects third contact 38 with right audio signal contact 46 and thus the right audio circuitry on printed circuit board 14. However, there is no risk of damage to the right audio circuitry due to electrostatic energy on third contact 38 because any such electrostatic energy was previous removed via prior contact with resilient member 58 and electrostatic discharge assembly 60, as discussed above. As can yet further be seen in FIG. 7, resilient member 52 is now engaging second contact 34 of electrical plug 22. This engagement electrically connects second contact 34 with common audio ground contact 18 and thus the common audio ground of the circuit on printed circuit board 14. However, there is no risk of damage to the common audio ground of this circuit due to electrostatic energy on second contact 34 because any such electrostatic energy was previous removed via prior contact with resilient member 58 and electrostatic discharge assembly 60, as also discussed above.

Figure 8:
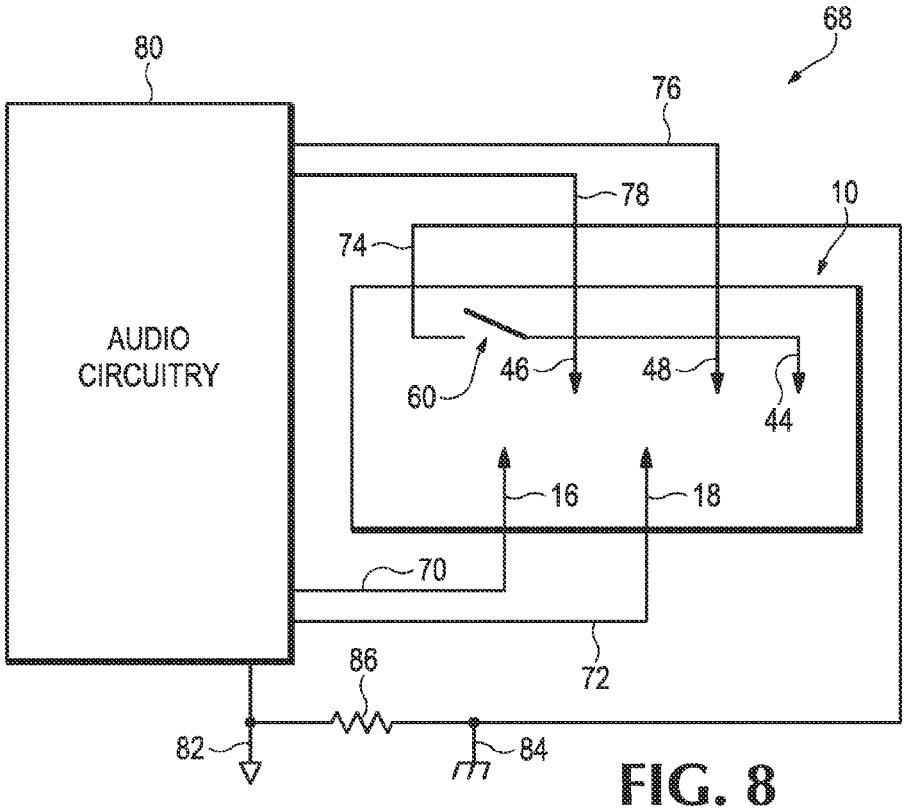
FIG. 8 is a schematic of an example of an electrical circuit.

A schematic of an example of an electrical circuit 68 is shown in FIG. 8. As can be seen in FIG. 8, electrical circuit 68 includes electrical jack 10 and the above-described electrostatic discharge assembly 60. Electrical circuit 68 also includes the above-described left audio signal contact 16, common audio ground contact 18, electrostatic discharge contact 44, right audio signal contact 46, and microphone signal contact 48. Electrical circuit 68 additionally includes left audio signal path 70, common audio ground path 72, electrostatic discharge path 74, microphone signal path 76, and right audio signal path 78 each of which are electrically connected to audio circuitry 80. Audio circuitry 80 can be used in any of a variety of devices such as computers or audio devices.

As can further be seen in FIG. 8, electrical circuit 68 further includes a common audio ground 82 to which audio circuitry 80 and common audio ground path 72 are both electrically connected. Electrical circuit 68 also further includes a terminal ground path 84 to which electrostatic discharge path 74 is electrically connected. Terminal ground 84 is electrically isolated from common audio ground 82 by an impedance 86. In one or more examples, terminal ground 84 may be connected to the chassis ground of the particular electronic device or component.

Although several examples have been described and illustrated in detail, it is to be clearly understood that the same are intended by way of illustration and example only. These examples are not intended to be exhaustive or to limit the invention to the precise form or to the exemplary embodiments disclosed. Modifications and variations may well be apparent to those of ordinary skill in the art. For example, other uses of electrical jack 10 in electrical circuits may include cameras, mobile devices such as personal digital assistants, and test and measurement equipment. As another example, the electrical jack may include a fewer or a greater number of signal contacts than the example of electrical jack 10. As a further example, the size of electrical jack 10 and electrical plug 22 can vary and is not dependent on that illustrated in the Figures. Rather, they can be larger, smaller or the same size as illustrated. As yet a further example, the general concepts described herein apply to any circuitry utilizing a grounding scheme intentionally separating signal ground and common chassis ground at the input and output (I/O) connection interface, for high-fidelity analog or digital signal conditioning purposes. The spirit and scope of the present invention are to be limited only by the terms of the following claims.

Additionally, reference to an element in the singular is not intended to mean one and only one, unless explicitly so stated, but rather means one or more, Moreover, no element or component is intended to be dedicated to the public regardless of whether the element or component is explicitly recited in the following claims.

What is claimed is:

1. An electrical jack for an electrical plug of contacts, comprising;

an enclosure defining a space in which the electrical plug is inserted; and an electrostatic discharge assembly positioned in the enclosure and including a switch configured to assume a normally closed position to complete a closed circuit with each of the contacts of the electrical plug during insertion within the space, thereby discharging electrostatic energy present on the contacts of the electrical plug, and further configured to move from the normally closed position to an open position to present an open circuit to each of the contacts of the electrical plug upon insertion of the electrical plug within the space to a predetermined point.

2. The electrical jack of claim 1, wherein the electrical discharge assembly includes an electrostatic discharge contact wherein the switch is connected to the electrostatic discharge contact in the normally closed position and disconnected from the electrostatic discharge contact in the open position.

3. The electrical jack of claim 1, wherein the electrical discharge assembly includes an actuator designed to electrically Insulate the switch from the contacts of the electrical plug.

4. The electrical jack of claim 1, wherein the electrical discharge assembly includes an actuator is configured to deflect toward the switch upon engagement within the electrical plug inserted within the space.

5. The electrical jack of claim 2, wherein the electrostatic discharge contact includes a resilient member positioned within the space that engages each of the contacts of the electrical plug upon insertion of the electrical plug within the space.

6. The electrical jack of claim 1, wherein the predetermined point of insertion of the electrical plug with the cavity is selected to be a point within the cavity corresponding to an inserted length of the electrical plug.

7. An electrical jack for an electrical plug, compromising:

a housing defining a cavity designed to receive the electrical plug;

a signal contact;

a ground contact;

an electrostatic discharge contact; and a switch positioned in the cavity and configured both to assume a normally closed position connected to the electrostatic discharge contact and to have an open position disconnected from the electrostatic discharge contact, and further configured to move from the normally closed position to the open position upon insertion of the electrical plug within the cavity to a predetermined point.

8. The electrica1 jack of claim 7, further comprising an actuator positioned within the cavity adjacent the switch and configured to deflect toward the switch upon engagement with the electrical plug inserted within the cavity.

9. The electrical jack of claim 8, wherein the actuator is further configured to Electrically insulate the switch from the electrical plug.

10. The electrical jack of claim 7, wherein the predetermined point of insertion of the electrical plug within the cavity is selected to be a point within the cavity corresponding to an inserted length of the electrical plug.

11. The electrical jack of claim 7, wherein the signal contact, the ground contact, and the electrostatic discharge contact are each configured to include a resilient member that engages a different portion of the electrical plug upon insertion of the electrical plug within the cavity to the predetermined point.

12. The electrical jack of claim 7, wherein the electrostatic discharge contact is configured to be electrically isolated from both the signal contact and the ground contact.

13. An electrical circuit for an electrical plug having a plurality of contacts, comprising;

a signal path;

a ground path;

an electrostatic discharge path; and an electrical jack assembly electrically connected to the signal path, the ground path and the electrostatic discharge path, configured to define a cavity designed to receive the electrical plug,and including a switch configured to assume a normally closed position to create a closed circuit between each of the contacts of the electrical plug and the electrostatic discharge path daring insertion of the electrical plug within the cavity, and further configured to move from the normally closed position to an open position to create an open circuit between each of the contacts of the electrical plug and the electrostatic discharge path upon completion of insertion of the electrical plug within the cavity.

14. The electrical circuit of claim 13, wherein the electrostatic discharge path is electrically connected to a chassis ground path configured to be electrically isolated from the ground path.

15. The electrical circuit of claim 14, further comprising an impedance connected between the electrostatic discharge path and the chassis ground path.

16. The electrical circuit of claim 13, wherein the electrostatic discharge path is further configured to be electrically isolated from the signal path and the ground path.

17. The electrical circuit of claim 13, wherein the switch is connected to an electrostatic discharge contact electrostatic discharge contact of the electrical jack assembly in the normally closed position and disconnected from the electrostatic discharge contact if the open position.

18. The electrical circuit of claim 13, wherein the electrical jack assembly includes an actuator configured to electrically insulate the switch from the electrical plug.

19. The electrical circuit of claim 13, wherein the electrical jack assembly includes an actuator positioned within the cavity adjacent the switch and configured to deflect toward the switch upon engagement with the electrical plug inserted within the cavity.

20. The electrical circuit of claim 17, wherein the electrostatic discharge contact includes a resilient member that engages each of the contacts of the electrical plug upon insertion of the electrical plug within the cavity.

21. The electrical circuit of claim 13, wherein the signal path is configured to include a microphone signal, a right audio signal, and a left audio signal.

* * * * *

UNITED STATES PATENT AND TRADEMARK OFFICE

CERTIFICATE OF CORRECTION

PATENT NO. : 8,602,801 B2
APPLICATION NO. : 13/403305
DATED : December 10, 2013
INVENTOR(S) : J. Scott Sylvester et al.

It is certified that error appears in the above-identified patent and that said Letters Patent is hereby corrected as shown below:

In the Claims

In column 7, line 26, in Claim 1, after "plug" insert -- having a plurality --.

In column 7, line 27, in Claim 1, delete "comprising;" and insert -- comprising: --, therefor.

In column 7, line 49, in Claim 3, delete "Insulate" and insert -- insulate --, therefor.

In column 7, line 53, in Claim 4, delete "within" and insert -- with --, therefor.

In column 8, line 10, in Claim 8, delete "electrica1" and insert -- electrical --, therefor.

In column 8, line 15, in Claim 9, delete "Electrically" and insert -- electrically --, therefor.

In column 8, line 31, in Claim 13, delete "comprising;" and insert -- comprising: --, therefor.

In column 8, line 38, to Claim 13, delete "plug,and" and insert -- plug, and --, therefor.

In column 8, line 41, in Claim 13, delete "daring" and insert -- during --, therefor.

In column 8, lines 59-60, in Claim 17, after "contact" delete "electrostatic discharge contact".

In column 8, line 62, in Claim 17, delete "if" and insert -- in --, therefor.

Signed and Sealed this
Eleventh Day of March, 2014

Michelle K. Lee

Michelle K. Lee
*Deputy Director of the United States Patent and Trademark Office*